US007757770B2

(12) United States Patent
Wilson

(10) Patent No.: US 7,757,770 B2
(45) Date of Patent: Jul. 20, 2010

(54) METHOD OF STIMULATING A COALBED METHANE WELL

(75) Inventor: Dennis R. Wilson, Aztec, NM (US)

(73) Assignee: ConocoPhillips Company, Houston, TX (US)

( * ) Notice: Subject to any disclaimer, the term of this patent is extended or adjusted under 35 U.S.C. 154(b) by 522 days.

(21) Appl. No.: 11/679,306

(22) Filed: Feb. 27, 2007

(65) Prior Publication Data

US 2008/0202757 A1 Aug. 28, 2008

(51) Int. Cl.
*E21B 43/26* (2006.01)

(52) U.S. Cl. ..... 166/308.1; 166/300; 166/308.6

(58) Field of Classification Search ..... None
See application file for complete search history.

(56) References Cited

U.S. PATENT DOCUMENTS 4,391,327 A * 7/1983 De Carlo ..... 166/307
4,615,564 A * 10/1986 Garrett ..... 299/7
4,995,463 A * 2/1991 Kramm et al. ..... 166/308.2
5,014,788 A 5/1991 Puri et al.
5,147,111 A * 9/1992 Montgomery ..... 299/16
5,411,098 A 5/1995 Schmidt et al.
5,417,286 A 5/1995 Palmer et al.
5,419,396 A 5/1995 Palmer et al.
5,439,054 A 8/1995 Chaback et al.
5,464,061 A 11/1995 Wilson et al.
5,474,129 A 12/1995 Weng et al.
5,494,108 A 2/1996 Palmer et al.
5,685,374 A 11/1997 Schmidt et al.
2004/0256104 A1 12/2004 Wilson et al.
2007/0227732 A1 * 10/2007 Miller et al. ..... 166/281

OTHER PUBLICATIONS

Fracturing Technologies for Improving CMM/CBM Production, PBD, Dec. 1, 2002, 10 pages, Report prepared for the U.S. Environmental Protection Agency by Advanced Resources International under Contract 68-W-00-094.

* cited by examiner

*Primary Examiner*—Zakiya W Bates
*Assistant Examiner*—Angela M DiTrani

(57) ABSTRACT

A method of stimulating gas production from a coalbed methane well that involves injecting a foam forming liquid and an expandable fluid into a coal seam proximate the wellbore. When the wellbore pressure is reduced, at least a portion of the expandable fluid can vaporize, which can generate foam that aids in the formation and/or enlargement of a cavity in the coal seam proximate the wellbore.

34 Claims, 4 Drawing Sheets

METHOD OF STIMULATING A COALBED METHANE WELL

BACKGROUND OF THE INVENTION

1. Field of the Invention

This invention relates to a method of stimulating a subterranean coal seam in order to increase gas production therefrom. In another aspect, this invention relates to a method of cavitating a coal seam that employs a foam forming liquid and an expandable fluid.

2. Description of the Prior Art

Many subterranean coal seams contain large volumes of trapped hydrocarbon gases including, for example, methane. When economically produced, these gas reserves represent a valuable resource. Once a coalbed well has been drilled and completed, it is common to treat the surrounding coal seam in order to stimulate the gas production therefrom. Generally, stimulation or "workover" procedures involve creating and/or enlarging pathways for the methane gas to travel from within the formation to the wellbore. Presently, two common methods of stimulating methane production from coalbed wells include hydraulic fracturing and "cavity induced stimulation" or cavitation.

Hydraulic fracturing involves introducing a fracturing fluid into the coal seam at a pressure above the fracture pressure of the coal formation. Hydraulically fractured wells are cased throughout the coal seam and the casing is perforated to allow the fracturing fluid to enter the coal seam at an elevated pressure. One concern associated with hydraulic fracturing is the significant amount of damage it causes the natural cleat network in the coal seam surrounding the wellbore, which adversely impacts the production rate of the well. In addition, the coal fines generated as a result of the high pressure fluid injection combine with the fracturing fluid and plug the natural cleats in the surrounding coal seam, which adversely impacts the gas production rate.

Cavitation is another method employed to stimulate gas production from coalbed methane wells. In general, cavitation involves the formation and/or enlargement of a cavity in the near wellbore region of the coal seam. Typically, cavitation is accomplished by allowing fluid pressure to build in the coal seam and then releasing the pressure to fragment a portion of the coal, which creates and/or enlarges a cavity in the coal seam. Cavitation can also increase the permeability of the surrounding formation, which results in greater increases in gas production rates compared to hydraulically stimulated wells. Thus, cavitation is often the preferred method of coalbed stimulation. However, current cavitation methods have limited effectiveness when applied to certain types of coalbed methane wells, especially wells penetrating coal seams having a high permeability and a low reservoir pressure.

Thus, a need exists for an improved method of increasing gas production from a coalbed methane well that minimizes coal seam damage and can be successfully applied to various types of coal seams.

SUMMARY OF THE INVENTION

In one embodiment of the present invention, there is provided a method for cavitating a subterranean coal seam, the method comprising: (a) injecting a first foam forming liquid into a wellbore penetrating at least a portion of the coal seam; (b) injecting an expandable fluid into the wellbore; (c) vaporizing at least a portion of the injected expandable fluid to thereby form an expanded gas, wherein the vaporizing of the expandable fluid causes the formation of a foam from at least a portion of the expanded gas and at least a portion of the first foam forming liquid; and (d) fragmenting coal from the coal seam proximate the wellbore to thereby form and/or enlarge a cavity in the coal seam.

In another embodiment of the present invention, there is provided a method of increasing production from a wellbore penetrating at least a portion of a subterranean coal seam, the wellbore comprising a casing, a tubing string, and an annulus defined therebetween, the method comprising: (a) passing a first fluid downward through the tubing string; (b) simultaneously with step (a), passing a second fluid downward through the annulus; (c) using at least a portion of the first fluid and at least a portion of the second fluid to generate a foam in the coal seam proximate the wellbore; (d) at least partially depressurizing the wellbore to thereby reduce the pressure of the coal seam; (e) fragmenting coal from the coal seam proximate the wellbore to thereby form and/or enlarge a cavity in the coal seam; and (f) removing at least a portion of the foam and the fragmented coal through the wellbore.

In a further embodiment of the present invention, there is provided a method of increasing production from a wellbore penetrating at least a portion of a subterranean coal seam, the method comprising: (a) introducing a first fluid comprising water and a surfactant into the wellbore; (b) after step (a), introducing a second fluid comprising liquid carbon dioxide into the wellbore; (c) after step (a), introducing a third fluid comprising water and a surfactant into the wellbore; and (d) fragmenting coal from the coal seam proximate the wellbore to thereby form and/or enlarge a cavity in the coal seam.

In yet another embodiment of the present invention, there is provided an apparatus for cavitating a subterranean coal seam. The apparatus comprises a wellbore penetrating a coal seam. The wellbore comprises a casing, a tubing string, and an annulus defined therebetween. The apparatus comprises a foam forming liquid source operable to discharge a foam forming liquid into the wellbore through the annulus and/or tubing string and an expandable liquid source operable to discharge an expandable liquid into the wellbore through the annulus and/or tubing string. The apparatus comprises a pressure regulating device operable to reduce the pressure of the wellbore to vaporize at least a portion of the expandable liquid and fragment coal from the coal seam and a vent line operable to remove at least a portion of the vaporized expandable liquid and the fragmented coal from the coal seam.

BRIEF DESCRIPTION OF THE DRAWINGS

Certain embodiments of the present invention are described in detail below with reference to the enclosed drawings, wherein.

DETAILED DESCRIPTION

Figure 1:
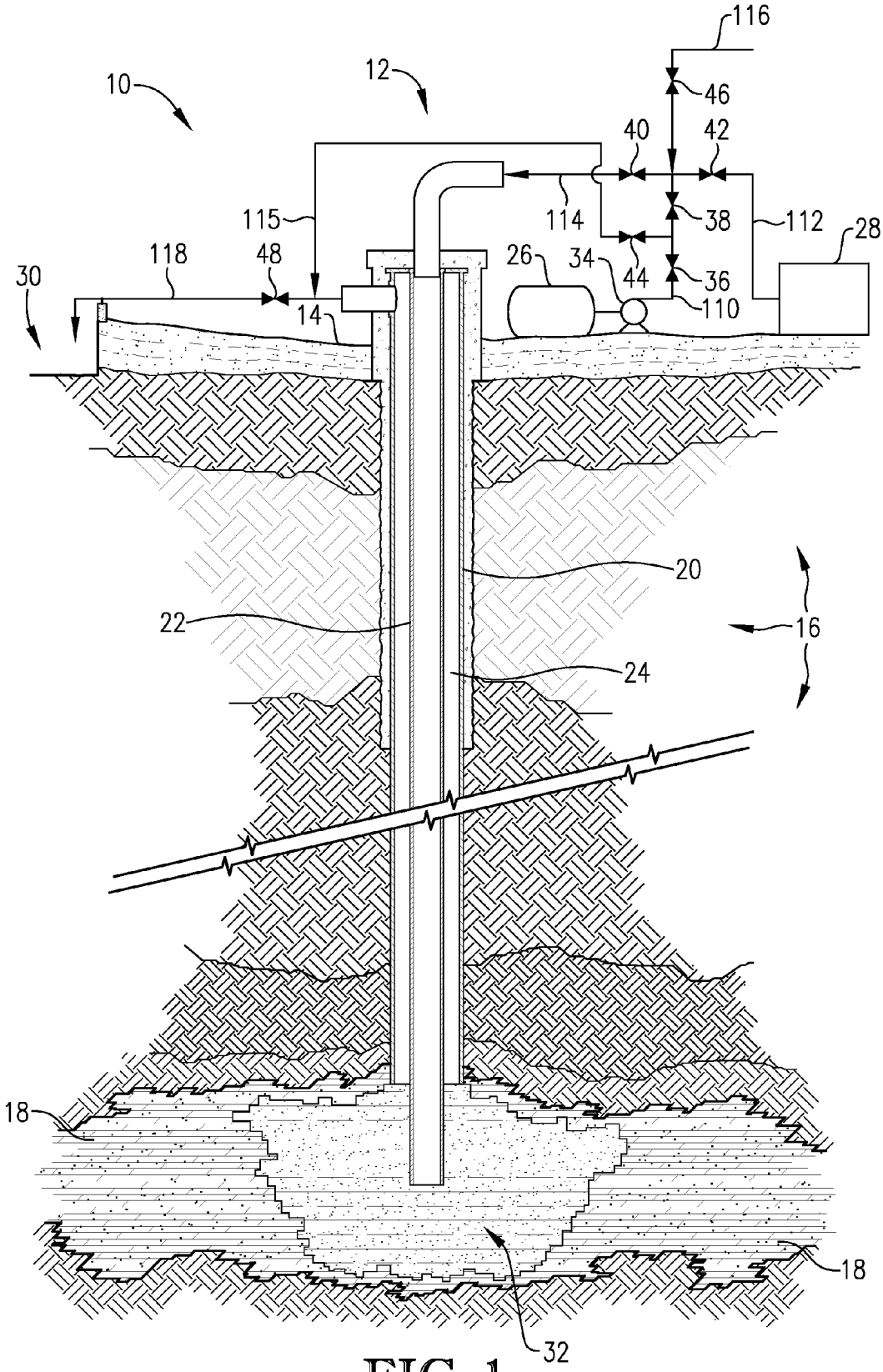
FIG. 1 is a schematic depiction of a wellbore penetrating a subterranean coal seam in accordance with one embodiment of the present invention.

Turning initially to FIG. 1, a coalbed methane well 10 is illustrated as generally comprising a wellbore 12 extending from a ground surface 14 through layered subterranean formations 16 and penetrating at least a portion of a coal seam 18 containing a hydrocarbon gas (e.g., methane). In one embodiment, wellbore 12 can have a total depth in the range of from about 1000 to about 5000 feet below ground surface 14, about 1500 to about 4000 feet below ground surface 14, or 2000 to 3750 feet below ground surface 14. Although illustrated in FIG. 1 as being substantially vertical, wellbore 12 can be of any known orientation, such as, for example, a wellbore than has been directionally drilled in any angle from substantially vertical to substantially horizontal. Further, wellbore 12 can be cased-hole completed or open-hole completed at the time the present invention is employed.

As shown in FIG. 1, wellbore 12 can generally comprise a casing 20 and a tubing string 22. Tubing string 22 can be disposed within casing 20 to thereby create an annulus 24 therebetween. Tubing string 22 can be in fluid communication with a foam forming liquid source 26 and/or an expandable fluid source 28. Annulus 24 can be in fluid communication with foam forming liquid source 26 and/or a burn pit 30.

In accordance with one embodiment of the present invention, a foam forming liquid originating from foam forming liquid source 26 and an expandable fluid originating from expandable fluid source 28 can be injected through wellbore 12 and into coal seam 18, thereby creating a high pressure area in the near wellbore region of coal seam 18. When this area is subsequently depressurized, at least a portion of the expandable gas can vaporize, which can cause foam to form near wellbore 12 in coal seam 18. The depressurization can also cause a portion of the coal in coal seam 18 to fragment and, thereafter, at least a portion of the fragmented coal and/or foam can be removed from coal seam 18 to form a cavity therein. After the cavitation process is completed, the remaining fragmented coal can be cleaned from the near wellbore region of coal seam 18 prior to initiating methane production from wellbore 12. Several embodiments of the present invention for stimulating coalbed methane well 10 illustrated in FIG. 1 will now be described in detail with reference to the flow charts provided in FIGS. 2 through 5.

Figure 2:
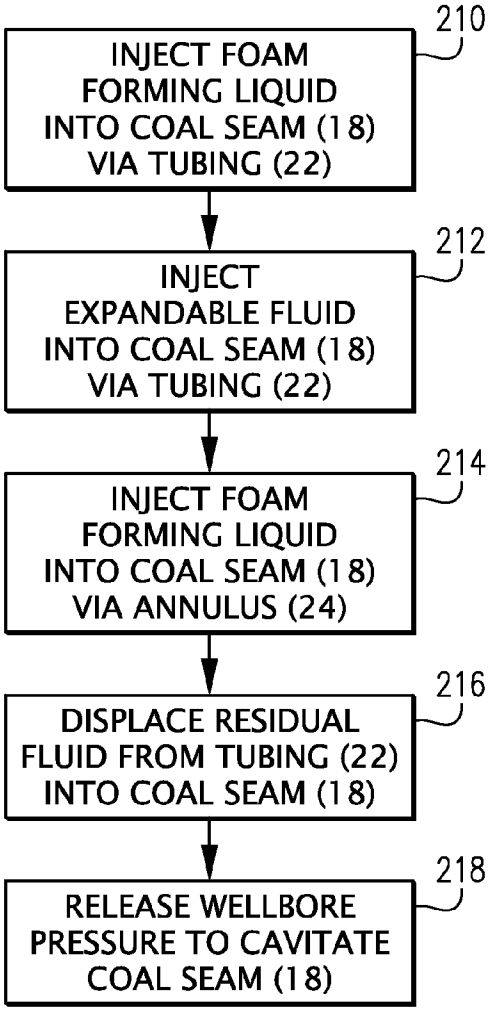
FIG. 2 is a flowchart representing steps involved in one embodiment of the method of cavitating the wellbore illustrated in FIG. 1.

Referring initially to FIG. 2, the major steps according to one embodiment of the present invention are outlined in the flowchart provided. As shown by block 210, a stream of the form forming fluid can be injected through tubing string 22 of wellbore 12 and into coal seam 18. The foam forming liquid can be any liquid capable of forming foam in coal seam 18. In one embodiment, the foam forming liquid can have a density at standard temperature and pressure (STP) of at least about 20 pounds per cubic foot (lb/ft$^3$), at least about 40 lb/ft$^3$, or at least 50 lb/ft$^3$. As used herein, STP is defined as 32° F. and 14.696 psia. Generally, the foam forming liquid can comprise water and/or a surfactant. The volume ratio of water to surfactant in the foam forming liquid can be in the range of about 50:1 to about 1000:1, about 75:1 to about 850:1, or 150:1 to 450:1. Examples of surfactants suitable for use in the present invention can include, but are not limited coco-trimethyl quaternary amines, perflourinated quaternary ammonium iodide, and nonylphenol+10 moles of ethylene oxide.

As shown in FIG. 1, a stream of the foam forming liquid can be withdrawn from foam forming liquid source 26 and can enter the suction of pump 34. The stream discharged from pump 34 in conduit 110 can subsequently pass through valves 36, 38, 40 and into conduit 114 prior to entering the upper portion of tubing string 22, whereafter it flows downward through tubing string 22 and into coal seam 18. In one embodiment, at least about 0.5 barrel, or in the range of from about 1 to about 40 barrels, or 5 to 20 barrels of the foam forming liquid can be injected into coal seam 18 via wellbore 12.

Referring back to the flow chart illustrated in FIG. 2, a stream of the expandable fluid can then be injected via tubing string 22 into coal seam 18, as represented by block 212. The expandable fluid can be any fluid that has a density at 150° F. and 2,000 pounds per square inch absolute (psia) that is at least about 20 percent less than the density of the fluid at 50° F. and 2,000 psia. Further, the expandable fluid can have a density at 150° F. and 2,000 psia that is at least 40 percent less than the density of the fluid at 50° F. and 2,000 psia. The expandable fluid of the well treatment medium can have a density at a temperature of about −4° F. and a pressure of about 286 psia in the range of from about 50 to about 80 lb/ft$^3$, in the range of from about 60 to about 70 lb/ft$^3$, or in the range of from 63 to 67 lb/ft$^3$. The expandable fluid can be a gas at STP. Furthermore, the expandable fluid can have a density at STP in the range of from about 0.02 to about 1.00 lb/ft$^3$, in the range of from about 0.05 to about 0.50 lb/ft$^3$, or in the range of from 0.075 to 0.20 lb/ft$^3$. The expandable fluid can have a density at a temperature of about 150° F. and a pressure of about 2,000 psia in the range of from about 10 to about 80 lb/ft$^3$, in the range of from about 15 to about 50 lb/ft$^3$, or in the range of from 20 to 40 lb/ft$^3$. In one embodiment, the expandable fluid can be at least partially soluble in the foam forming liquid. Specific examples of the expandable fluids suitable for use in the present invention include, but are not limited to, propane, butane, and carbon dioxide. In one embodiment, the expandable fluid can comprise carbon dioxide.

As shown in FIG. 1, a stream of the expandable fluid from expandable fluid source 28 can be pressured to wellbore 12 without using a pump. In another embodiment, the expandable fluid stream in can be transferred to wellbore 12 using a pump (not shown). As illustrated in FIG. 1, the stream from expandable fluid source 28 can pass to wellbore 12 via conduit 112, valves 42, valve 40, and conduit 114. The expandable fluid stream can be introduced into wellbore 12 as a liquid and then flow down tubing string 22 and out into coal seam 18. The pressure of the expandable fluid entering wellbore 12 can generally be in the range of from about 10 to about 700 psia, about 50 to about 350 psia, or 100 to 250 psia. The temperature of the expandable fluid entering wellbore 12 can be in the range of from about 0 to about 100° F., about 5 to about 50° F., or from 10 to 30° F. Generally, the expandable fluid can enter coal seam 18 at a pressure below its fracturing pressure. The total amount of expandable fluid introduced into wellbore 12 can be at least about 1 barrel, or in the range of from about 2 to about 50 barrels, or 5 to 30 barrels of the expandable fluid can be injected into coal seam 18 via wellbore 12.

As shown by block 214 in FIG. 2, a stream of the form forming liquid can be injected into coal seam 18 via annulus 24. In one embodiment, the foam forming liquid can have a similar composition as the foam forming liquid injected in the step represented by block 210. In another embodiment, the foam forming liquid injected can have a different composition than the foam forming liquid injected in the previous step.

As shown in FIG. 1, a stream of the foam forming liquid from foam forming liquid source 26 can be withdrawn and enter the suction of pump 34. The discharged stream in conduit 110 passes through valves 36 and 44 and can flow into annulus 24 of wellbore 12 via conduit 115. In one embodiment, the total volume of the foam forming liquid discharged into annulus 24 via conduit 115 can be at least about 1 barrel, or in the range of from about 2 to about 40 barrels, or 5 to 20 barrels. In coal seam 18, at least a portion of the expandable fluid can dissolve in the foam forming liquid to thereby form a combined liquid phase. In one embodiment of the present invention, the volume ratio of the total amount of the expandable fluid to the total amount of the foam forming liquid added to wellbore 12 can be in the range of from about 0.05:1 to about 20:1, about 0.1:1 to about 10:1, or 0.2:1 to 5:1.

As depicted by block 216 in FIG. 2, the residual expandable fluid in tubing string 22 can then be discharged into coal seam 18. In one embodiment, compressed air or other gas can be used to force the residual fluid in tubing string 22 into coal seam 18. As illustrated in FIG. 1, a stream of compressed air from a recavitation rig (not shown) in conduit 116 can be sent through valves 46 and 40 and into tubing string 22 via conduit 114. Compressed air may be continuously injected into tubing string 22 until a slight reduction in the outlet pressure of wellbore 12 is observed, which can indicate that substantially all of the residual fluid has exited tubing string 22.

At this point, the pressure of coal seam 18 proximate wellbore 12 can be at least about 500 psia, in the range of from about 2000 to about 6000 psia, or in the range of from about 3000 to about 5000 psia. Under these conditions, at least a portion of the expandable fluid in coal seam 18 can be in a critical or supercritical state. As illustrated by block 218 in FIG. 2, the wellbore pressure can be released in order to cavitate at least a portion of coal seam 18. According to one embodiment illustrated in FIG. 1, wellbore 12 can be at least partially depressurized by adjusting a pressure regulating device, illustrated herein as a valve 48, which places wellbore 12 in communication with an atmospheric vent line (i.e., "blooey line") 118 that terminates in burn pit 30. The depressurization of wellbore 12 can result in a wellbore pressure that is reduced by at least about 50 psia, at least about 200 psia, at least about 500 psia, or at least 1000 psia. Generally, the depressurization can take place over a period of time of less than about 90 minutes, less than about 45 minutes, or less than 15 minutes. This relatively rapid depressurization of wellbore 12 can cause at least a portion of the expandable fluid in coal seam 18 to vaporize. In one embodiment, at least about 10 percent, at least about 25 percent, at least about 50 percent, or at least about 75 percent of the expandable fluid can be vaporized to form an expanded gas. As the expanded gas effervesces from the liquid phase, a foam comprising a portion of the foam forming liquid and the expanded gas can be generated in coal seam 18. Generally, at least about 5 percent, at least about 25 percent, at least about 50 percent, or at least 75 percent of the volume of the foam forming liquid injected into coal seam 18 via wellbore 12 can be used to generate the foam. In one embodiment, at least about 5 percent, at least about 25 percent, at least about 50 percent, at least about 75 percent, or at least 90 percent of the volume of expanded gas created in coal seam 18 can be used to generate the foam. In general, the foam can comprise in the range of from about 20 to about 98, about 30 to about 95, or 60 to 90 weight percent of the expanded gas and/or about 1 to about 60, about 2 to about 50, or 5 to 40 weight percent of the foam forming liquid, based on the total weight of the foam.

In accordance with one embodiment of the present invention, the foam can flow into the fractures of coal seam 18 proximate wellbore 12 to temporarily reduce the effective permeability of coal seam 18 in order to divert a majority of the expanded gas into the coal matrix. During the depressurization of wellbore 12, the foam can prevent the rapid loss of gas through the fractures in coal seam 18, thereby maximizing the force that the expanded gas in the coal matrix can apply to the coal matrix. This force applied to the coal matrix as the result of the depressurization of wellbore 12 can cause a portion of the coal to fragment, which can result in the formation and/or enlargement of a cavity 32 in coal seam 18 proximate wellbore 12. According to one embodiment of the present invention, at least a portion of the fragmented coal can subsequently be removed from cavity 32 through wellbore 12. In one embodiment of the present invention, at least a portion of the foam and fragmented coal in cavity 32 can be forced through up annulus 24 and to burn pit 30 via blooey line 116 as a result of opening valve 48 to depressure wellbore 12. The amount of fragmented coal removed from wellbore 12 with the foam as a result of depressurization can be at least about 10 pounds, at least about 50 pounds, or at least 100 pounds. After depressurization, fragmented coal remaining in cavity 32 can be removed according to any well clean-out method known in the art.

Figure 3:
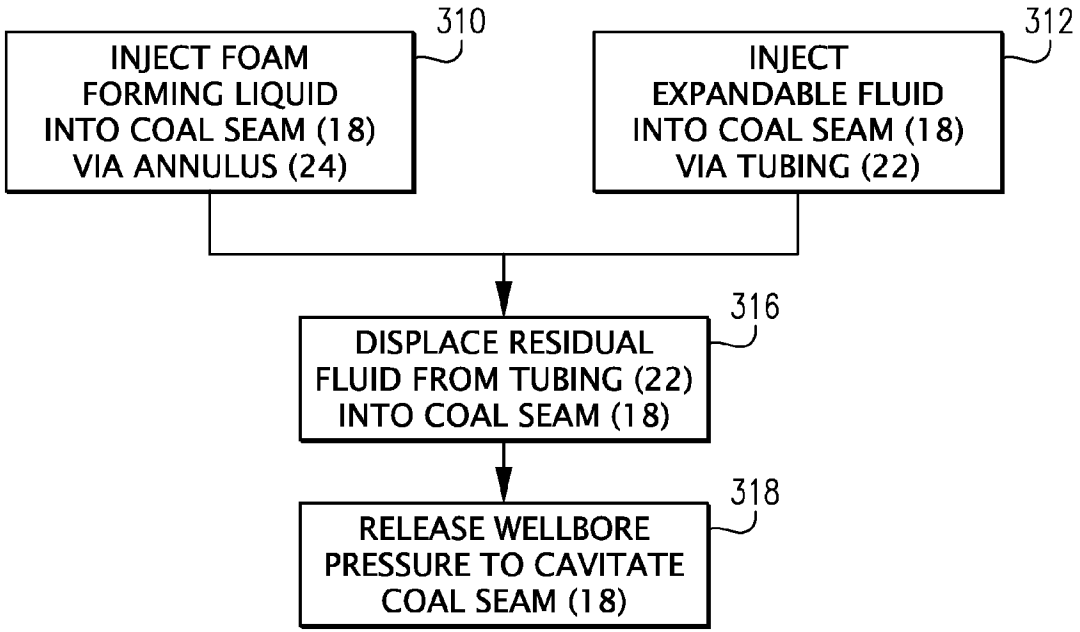
FIG. 3 is a flowchart representing steps involved in another embodiment of the method of cavitating the wellbore illustrated in FIG. 1.

Referring now to FIG. 3, a flow chart representing the major steps of another embodiment of the present invention is provided. The steps illustrated in the flow chart of FIG. 3, as they differ from the steps of the flow chart previously detailed with respect to FIG. 2, will now be discussed in detail. In one embodiment, the foam forming liquid and the expandable fluid can be simultaneously injected into coal seam 18 as illustrated by blocks 310 and 312 in FIG. 3. Generally, the foam forming liquid can be injected into coal seam 18 via annulus 24 and the expandable fluid can enter coal seam 18 via tubing string 22. Similarly to the embodiment previously described with respect to the flowchart provided in FIG. 2, the residual fluid in tubing string 22 can then be displaced into coal seam 18 prior to cavitating coal seam 18 by releasing its pressure, as depicted by respective blocks 316 and 318 in FIG. 3.

Figure 4:
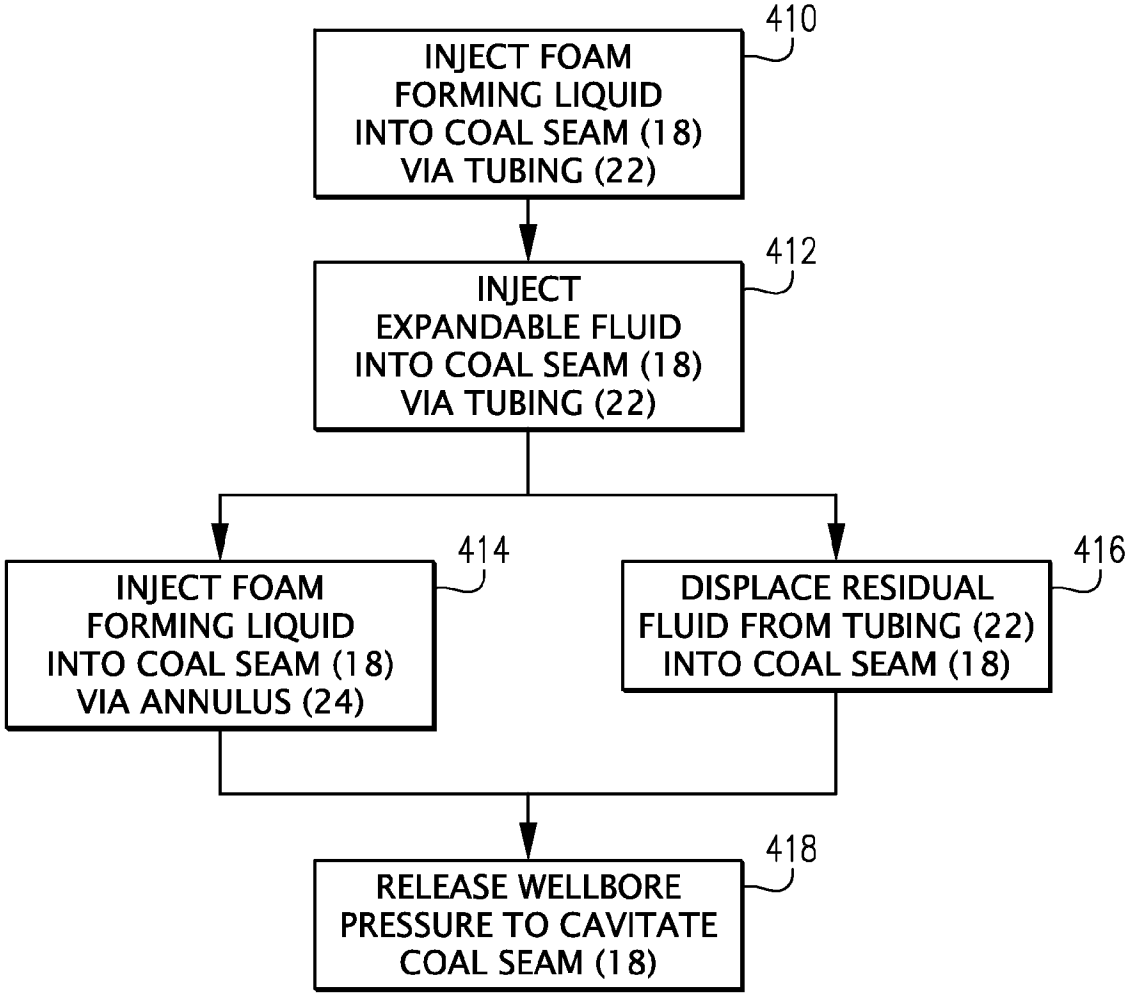
FIG. 4 is a flowchart representing steps involved in a further embodiment of the method of cavitating the wellbore illustrated in FIG. 1.

Referring now to FIG. 4, a flow chart representing a further embodiment of the present invention is provided. The steps illustrated in the flow chart of FIG. 4, as they differ from the steps of the flow chart previously detailed with respect to FIG. 2, will now be discussed in detail. Blocks 410 and 412 in FIG. 4 are generally analogous to blocks 210 and 212 in FIG. 2. According to one embodiment shown in FIG. 4, a stream of the foam forming liquid can be injected into coal seam 18 via annulus 24 at the same time the residual fluid in tubing string 22 is being displaced into coal seam 18. As shown by block 418, the pressure of wellbore 12 can then be released to cavitate coal seam 18, as discussed previously in detail with respect to FIG. 2.

Figure 5:
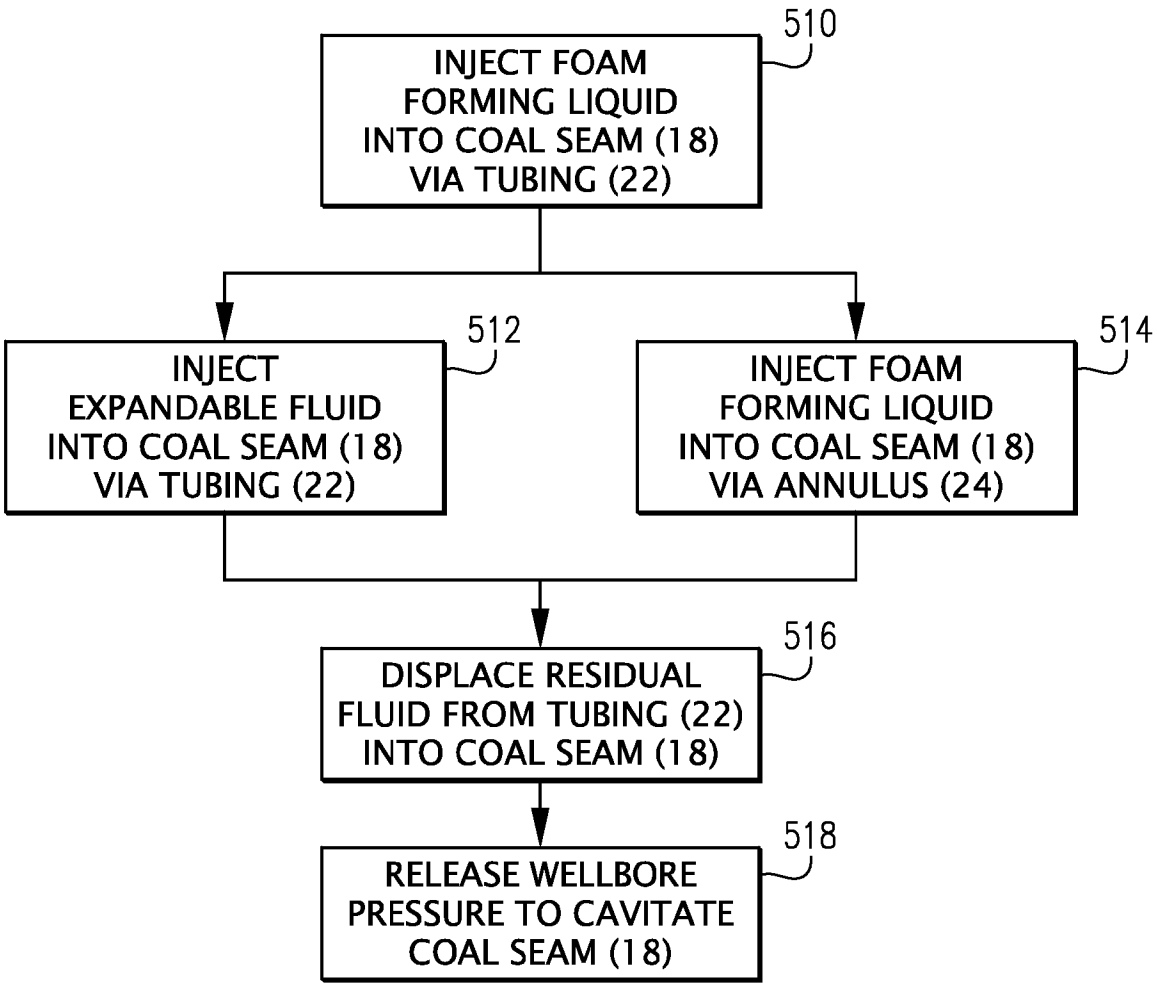
FIG. 5 is a flowchart representing steps involved in yet another embodiment of the method of cavitating the wellbore illustrated in FIG. 1.

Turning now to FIG. 5, a flow chart representing the major steps of yet another embodiment of the present invention is provided. The steps illustrated in the flow chart of FIG. 5, as they differ from the steps of the flow chart previously detailed with respect to FIG. 2, will now be discussed in detail. Block 510 in FIG. 5 is generally analogous to block 210 in FIG. 2. As depicted by blocks 512 and 514 of the flowchart shown in FIG. 5, the expandable fluid in tubing string 22 and the foam forming liquid annulus 24 can be simultaneously injected into coal seam 18. As shown by block 516, the residual fluid in tubing string 22 can then be displaced into coal seam 18 prior to cavitation, which was discussed in detail previously with respect to FIG. 2.

In one embodiment of the present invention, at least a portion of the expandable fluid can be combined with at least a portion of the foam forming liquid prior to being injected into coal seam 18 via tubing string 22 and/or annulus 24 of wellbore 12. For example, as illustrated in FIG. 1, a stream of the foam forming liquid can be withdrawn from foam forming liquid source 26 and can be discharged via pump 34 into conduit 110. Simultaneously, a stream of expandable fluid can enter conduit 112 from expandable fluid source 28. The foam forming liquid stream passing through valves 36 and 38 and the expandable fluid stream flowing through valve 42 can combine in conduit 114 and subsequently flow down tubing string 22 into coal seam 18. Alternatively, the expandable fluid in conduit 112 can pass through valves 42 and 38 and combine with the foam forming liquid stream exiting valve 36. The resulting combined stream can then flow through valve 44 and into annulus 24 via conduit 115. In general, the foam forming liquid and the expandable fluid can be combined at all elevated pressure (i.e., hydraulic pressure), which can cause the foam forming liquid to become supersaturated with the expandable fluid. As the combined stream is introduced into coal seam 18, the stream pressure is reduced and at least a portion of the expandable fluid can then vaporize from the solution, as previously discussed.

In one embodiment of the present invention, the rate of vaporization of the expandable fluid from the foam forming liquid can be increased by the addition of a release agent into one or more of the fluid streams entering wellbore 12. As used herein, the term "release agent" refers to a substance that increases the rate of vaporization of a solute from a solvent by at least about 25 percent, at least about 40 percent, or at least about 60 percent. The release agent can be a mechanical release agent and/or a chemical release agent. As used herein, the term "mechanical release agent" refers to a material used to accelerate the vaporization of the expandable fluid by creating interphase boundaries (i.e., nucleation sites) within the solution in order to promote more a rapid phase transition (i.e., vaporization). One example of a mechanical release agent is the bubbles of ascending expandable vapor caused by the previously discussed depressurization of wellbore 12. As the bubbles ascend, they can provide the energy and/or location for other bubbles to form, which can then expedite the vaporization of the expandable fluid. As used herein, "chemical release agent" refers to a substance that alters the surface tension of the solvent and/or solution in order to make the phase transition of the solute more thermodynamically favorable. A chemical release agent can be added any stream entering wellbore 12. In one embodiment, the chemical release agent can comprise a water soluble chemical release agent. Examples of chemical release agents suitable for use in the present invention include, but are not limited to, gums and/or carbohydrates.

According to one embodiment of the present invention, a stream of compressed air can be injected into wellbore 12 via tubing string 22 and/or annulus 24. In general, the compressed air stream can have a standard volumetric flow rate of at least about 100 standard cubic feet per minute (scfm), or in the range of from about 500 to about 10,000 scfm, about 1,000 to about 7500 scfm, or 1,500 to 5,000 scfm. As discussed previously, compressed air can originate from a recav rig or any other suitable source. In one embodiment, air can be injected into one of tubing string 22 and annulus 24, while a fluid stream is injected into the other. In another embodiment, air can be simultaneously injected with one or more fluid streams into tubing string 22 and/or annulus 24. As illustrated in FIG. 1, air can enter tubing string 22 via conduit 116 by passing through valves 46 and 40. Compressed air in conduit 116 can flow into annulus 24 via valves 46, 38, 44 and conduit 115.

In general, the flow rate of methane gas produced and the pressure profile can be two key metrics used to monitor the performance of well 10. In one embodiment, employing the present invention can result in an increase in the volumetric gas flow rate from well 10 of at least about 10 percent, at least about 25, at least about 75, or at least about 150 percent. In another embodiment, the pressure build rate of well 10 can increase by at least about 10 percent, at least about 25 percent, at least about 40 percent, or at least 60 percent after employing the method of the present invention.

The cavitation and clean-out steps outlined above can be repeated in order to achieve the desired gas flow rate, pressure profile, or other well performance metric. Generally, the cavitation and/or cleanout steps can be repeated at least 2, at least 5, at least 10, or at least 20 times in order to form a cavity of sufficient size to effectively stimulate well 10. In one embodiment, the above-described cavitation and clean-out steps can be repeated until at least about 100 pounds, at least about 1000 pounds, at least about 2000 pounds, or at least about 5000 pounds of fragmented coal has been removed from coal seam 18 through wellbore 12.

The present description uses numerical ranges to quantify certain parameters relating to the invention. It should be understood that when numerical ranges are provided, such ranges are to be construed as providing literal support for claim limitations that only recite the lower value of the range as well as claims limitation that only recite the upper value of the range. For example, a disclosed numerical range of 10 to 100 provides literal support for a claim reciting "greater than 10" (with no upper bounds) and a claim reciting "less than 100" (with no lower bounds).

As used herein, the terms "a," "an," "the," and "said" means one or more.

As used herein, the term "and/or," when used in a list of two or more items, means that any one of the listed items can be employed by itself, or any combination of two or more of the listed items can be employed. For example, if a composition is described as containing components A, B, and/or C, the composition can contain A alone; B alone; C alone; A and B in combination; A and C in combination; B and C in combination; or A, B, and C in combination.

As used herein, the terms "comprising," "comprises," and "comprise" are open-ended transition terms used to transition from a subject recited before the term to one or elements recited after the term, where the element or elements listed after the transition term are not necessarily the only elements that make up of the subject.

As used herein, the terms "containing," "contains," and "contain" have the same open-ended meaning as "comprising," "comprises," and "comprise," provided below.

As used herein, the terms "having," "has," and "have" have the same open-ended meaning as "comprising," "comprises," and "comprise," provided above As used herein, the terms "including," "includes," and "include" have the same open-ended meaning as "comprising," "comprises," and "comprise," provided above.

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

What is claimed is:

1. A method for cavitating a subterranean coal seam, said method comprising:

(a) injecting a first foam forming liquid into a wellbore penetrating at least a portion of said coal seam;

(b) injecting an expandable fluid into said wellbore as a liquid;

(c) vaporizing at least a portion of the injected expandable fluid to thereby form an expanded gas, wherein said vaporizing causes the formation of a foam from at least a portion of said expanded gas and at least a portion of said first foam forming liquid; and (d) fragmenting coal from said coal seam proximate said wellbore to thereby form or enlarge a cavity in said coal seam.

2. The method of claim 1, wherein at least a portion of said foam is formed in said coal seam.

3. The method of claim 1, further comprising removing at least a portion of said foam and the fragmented coal through said wellbore.

4. The method of claim 3, wherein said vaporizing is at least partially caused by at least partially depressurizing the wellbore.

5. The method of claim 4, wherein said depressurizing causes at least a portion of said removing by forcing said foam and the fragmented coal up and out of said wellbore.

6. The method of claim 4, wherein said fragmenting is at least partially caused by said depressurizing.

7. The method of claim 1, wherein the ratio of the amount of said expandable fluid introduced into said wellbore to the amount of said first foam forming liquid introduced into said wellbore is in the range of from about 0.2:1 to about 5:1 by liquid volume.

8. The method of claim 1, wherein at least about 25 weight percent of said expandable fluid is vaporized into said expanded gas.

9. The method of claim 1, wherein at least about 5 weight percent of said first foam forming liquid is used to form said foam and at least about 5 weight percent of said expandable fluid is used to form said foam.

10. The method of claim 1, wherein said expandable fluid is at least partially soluble in said first foam forming liquid.

11. The method of claim 1, wherein said expandable fluid comprises propane, butane, or carbon dioxide.

12. The method of claim 1, wherein said first foam forming liquid comprises a surfactant.

13. The method of claim 1, wherein said expandable fluid comprises carbon dioxide.

14. The method of claim 13, wherein said first foam forming liquid comprises a surfactant and water.

15. The method of claim 1, wherein steps (a) and (b) are carried out simultaneously.

16. The method of claim 1, further comprising repeating steps (a)-(d).

17. The method of claim 16, further comprising removing at least a portion of the fragmented coal through said wellbore, wherein steps (a)-(d) are repeated until at least about 100 pounds of the fragmented coal has been removed through said wellbore.

18. A method of increasing production from a wellbore penetrating at least a portion of a subterranean coal seam, said wellbore comprising a casing, a tubing string, and an annulus defined therebetween, said method comprising:

(a) passing a first fluid downward through said tubing string wherein said first fluid is a liquid as it is passed through said tubing string;

(b) simultaneously with step (a), passing a second fluid downward through said annulus wherein said second fluid is a liquid as it is passed through said annulus;

(c) using at least a portion of said first fluid and at least a portion of said second fluid to generate a foam in said coal seam proximate said wellbore;

(d) at least partially depressurizing said wellbore to thereby reduce the pressure of said coal seam;

(e) fragmenting coal from said coal seam proximate said wellbore to thereby form or enlarge a cavity in said coal seam; and (f) removing at least a portion of said foam and the fragmented coal through said wellbore.

19. The method of claim 18, wherein said depressurizing causes at least a portion of said second fluid to vaporize.

20. The method of claim 19, wherein the vaporizing of said second fluid causes at least a portion of the generation of said foam.

21. The method of claim 18, wherein said depressurizing causes at least a portion of said fragmenting of the coal.

22. The method of claim 18, wherein said depressurizing reduces the pressure of said coal seam by at least about 500 psi.

23. The method of claim 18, wherein at least a portion of steps (c), (d), (e), and (f) are carried out simultaneously.

24. The method of claim 18, further comprising repeating steps (a)-(f) until at least about 100 pounds of fragmented coal has been removed through said wellbore.

25. The method of claim 18, wherein said first fluid comprises a surfactant.

26. The method of claim 18, wherein said second fluid comprises carbon dioxide.

27. The method of claim 26, wherein said first fluid comprises a surfactant and water.

28. An apparatus for cavitating a subterranean coal seam, said apparatus comprising:

a wellbore penetrating a subterranean coal seam, said wellbore comprising a casing, a tubing string, and an annulus defined therebetween;

a foam forming liquid source operable to discharge a foam forming liquid into said wellbore through said annulus or said tubing string;

an expandable liquid source operable to discharge an expandable liquid into said wellbore in the form of a liquid through said annulus or said tubing string; a pressure regulating device operable to reduce the pressure of said wellbore to vaporize at least a portion of said expandable liquid and fragment coal from said coal seam; and a vent line operable to remove at least a portion of the vaporized expandable liquid and the fragmented coal from said coal seam.

29. The apparatus of claim 28, wherein said foam forming liquid source is operable to discharge said foam forming liquid into said wellbore through said annulus and said expandable liquid source is operable to simultaneously discharge said expandable liquid into said wellbore through said tubing string.

30. The apparatus of claim 29, wherein said foam forming liquid source is operable to discharge said foam forming liquid into said wellbore through said tubing string prior to the discharging of said foam forming liquid into said wellbore through said annulus.

31. The apparatus of claim 29, wherein said foam forming liquid source comprises a surfactant-containing foam forming liquid source and wherein said expandable liquid source comprises a carbon dioxide-containing expandable liquid source.

32. The apparatus of claim 28, wherein said foam forming liquid source is operable to discharge said foam forming liquid into said wellbore through said tubing string and said expandable liquid source is operable to sequentially discharge said expandable liquid into said wellbore through said tubing string.

33. The apparatus of claim 32, wherein said foam forming liquid source is operable to discharge said foam forming liquid into said wellbore through said annulus after the discharging of said foam forming liquid into said wellbore through said tubing string.

34. The apparatus of claim 28, wherein said expandable liquid source comprises a liquid carbon dioxide source.

* * * * *